US007444806B2

(12) United States Patent
Werber et al.

(10) Patent No.: US 7,444,806 B2
(45) Date of Patent: Nov. 4, 2008

(54) EXHAUST SYSTEM COMPONENT

(75) Inventors: Thomas Werber, Esslingen (DE); Arnulf Spieth, Hochdorf (DE)

(73) Assignee: J. Eberspaecher GmbH & Co, KG, Esslingen (DE)

( * ) Notice: Subject to any disclaimer, the term of this patent is extended or adjusted under 35 U.S.C. 154(b) by 0 days.

(21) Appl. No.: 11/680,817

(22) Filed: Mar. 1, 2007

(65) Prior Publication Data

US 2007/0209354 A1 Sep. 13, 2007

(30) Foreign Application Priority Data

Mar. 8, 2006 (DE) ..... 10 2006 011 091

(51) Int. Cl.
*F01N 7/00* (2006.01)

(52) U.S. Cl. ..... 60/322; 60/312; 60/324

(58) Field of Classification Search ..... 60/312, 60/322, 324

See application file for complete search history.

(56) References Cited

U.S. PATENT DOCUMENTS 3,545,565 A * 12/1970 McCaffrey, Jr. ..... 181/256
5,101,930 A * 4/1992 Fargo et al. ..... 181/233
5,962,821 A 10/1999 Iannetti
6,880,670 B2 * 4/2005 Dondi ..... 181/269

FOREIGN PATENT DOCUMENTS

| | | |
|---|---|---|
| EP | 1 524 415 | 4/2005 |
| JP | 8-82210 | 3/1996 |
| JP | 08-082210 * | 3/1996 |

* cited by examiner

*Primary Examiner*—Thomas Denion
*Assistant Examiner*—Diem Tran
(74) *Attorney, Agent, or Firm*—McGlew & Tuttle, P.C.

(57) ABSTRACT

An exhaust-carrying component (2) of an exhaust system (1) for an internal combustion engine is provided, in particular for a motor vehicle. The component (2) includes a pipe (4) through which exhaust gas can flow from one longitudinal end (6) to the other longitudinal end (7) and which has between its longitudinal ends (6, 7) a longitudinal section (8), the wall (9) of which is provided with perforations (10). The component (2) also has a housing (5) which surrounds the pipe (4) in a circumferential direction and to which the pipe (4) is fixedly connected in both one end area (11) having a longitudinal end (6) and in another end area (12) having the other longitudinal end (7). In order for the component (2) to nevertheless be able to resist the thermal stresses that occur during operation, the perforations (10) are designed so that the longitudinal section (8) can absorb thermal longitudinal expansion forces between the pipe (4) and the housing (5) through elastic deformation.

19 Claims, 1 Drawing Sheet

EXHAUST SYSTEM COMPONENT

CROSS REFERENCE TO RELATED APPLICATIONS

This application claims the benefit of priority under 35 U.S.C. §119 of German Patent Application DE 10 2006 011 091.9 filed Mar. 8, 2006, the entire contents of which are incorporated herein by reference.

FIELD OF THE INVENTION

The present invention relates to an exhaust-carrying component of an exhaust system for an internal combustion engine, in particular in a motor vehicle. The invention also relates to an exhaust system equipped with such a component.

BACKGROUND OF THE INVENTION

An exhaust system of an internal combustion engine, in particular in a motor vehicle, comprises a plurality of components, including an exhaust-carrying pipe installed in a housing. For example, there are pipes in mufflers that are arranged in a housing of the muffler. It may be necessary to design a wall of the respective pipe to be permeable for airborne sound, e.g., to allow airborne sound to enter an absorption space in which damping of the airborne sound may take place. To this end, the respective pipe may be provided with perforations. Front mufflers in particular are equipped with a perforated pipe surrounded by a housing in the circumferential direction, forming a ring-shaped absorption chamber.

Exhaust systems are exposed to high thermal stresses during operation, in particular during the warm-up phase of an internal combustion engine equipped with an exhaust system. Relatively great temperature differences may occur between an exhaust-carrying pipe on the inside and the housing on the outside. Additionally or alternatively, the pipe and housing may be made of different materials having different thermal expansion coefficients. This may result in extremely different thermal longitudinal stresses on the pipe on the one hand and the housing on the other hand. In order for no critical thermally induced stresses to occur between the pipe and the housing, it is customary to attach the respective pipe to the housing at only one of its end areas, whereas it is mounted on the housing to be displaceable in its longitudinal direction by means of a sliding seat at its other end area. In this way, the pipe may move in its longitudinal direction in relation to the housing, so that thermally induced stress does not occur between the pipe and the housing. However, the manufacturing expense for providing such a sliding seat is relatively great because it is necessary to comply with relatively narrow manufacturing tolerances must be observed in particular. Furthermore, such sliding seats may form a source for offending noise.

SUMMARY OF THE INVENTION

The present invention relates to the problem of providing an improved embodiment for a component and for an exhaust system of the type defined above that is characterized in particular by being inexpensive to manufacture.

The invention is based on the general idea of providing the pipe with an increased elastic flexibility in its longitudinal direction through targeted choice and/or design of the perforations. Through suitable dimensioning of the perforations, the flexibility of the pipe can be designed in a targeted manner, so that thermally induced longitudinal expansion forces between the pipe and the housing can be absorbed largely through elastic deformation by a longitudinal section of the pipe that is equipped with the perforations. Essentially minor plastic deformations can be tolerated as long as they do not endanger the pipe and/or the respective component. The perforations are designed so that the longitudinal section of the pipe furnished with the perforations acts more or less as a spring. Thermally induced longitudinal expansion can therefore be absorbed by the pipe with spring elasticity. Due to the spring elasticity of the pipe, which is achieved with the help of the perforations, it is possible to fixedly connect the pipe to the housing at both of its end areas. A sliding seat is then no longer necessary. This greatly simplifies the installation of the component and/or the exhaust system equipped with the perforated pipe and the housing. In particular, more identical parts can be used. The housing may be assembled from identical half-shells, for example. The pipe and/or the housing may be designed to be symmetrical, so that in particular no installation direction need be taken into account for the pipe.

Furthermore, due to the two end areas that are fixedly connected to the housing, there is a significant reinforcing effect of the housing, so that the component has an increased stability in this area.

Furthermore, there is a reduced tendency to develop noise, such as that which can occur in the area of a sliding seat, for example, due to relative movements.

According to an advantageous embodiment, the perforations may be formed by elongated holes whose longitudinal direction extends in the circumferential direction of the pipe. With this design, the elasticity of the pipe can be increased especially significantly in the longitudinal direction thereof.

Other important features and advantages of the invention are derived from the subclaims, the drawing and the respective description of figures on the basis of the drawing.

It is self-evident that the features mentioned above and those explained below may be used not only in the particular combination given but also in other combinations or alone without going beyond the scope of the present invention.

A preferred exemplary embodiment of the invention is illustrated in the drawing and explained in greater detail in the following description. The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENTS

Figure 1:
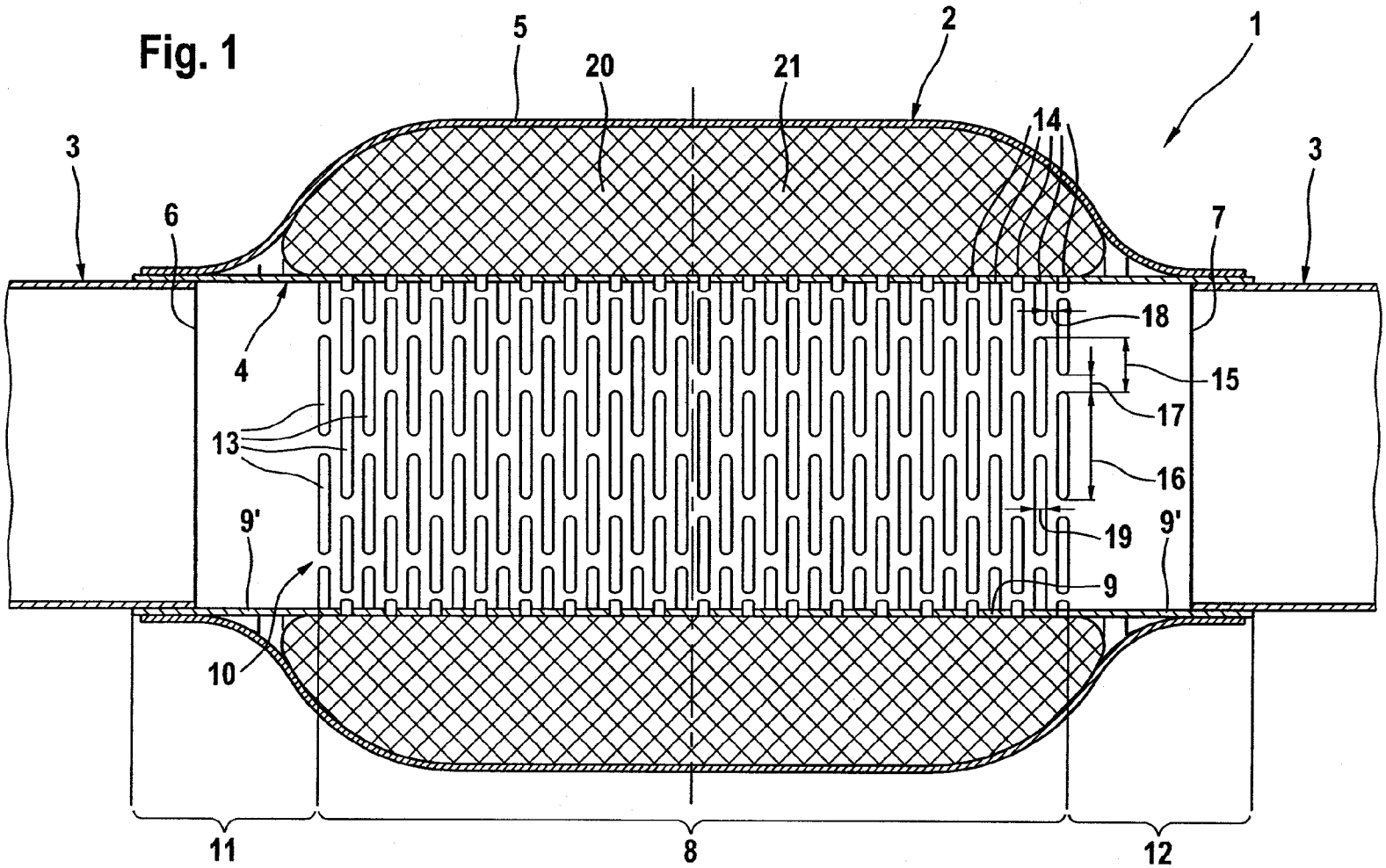
FIG. 1 is the only FIGURE and is a simplified longitudinal sectional view through a component of an exhaust system according to the invention.

Referring to the drawings in particular, according to FIG. 1, an exhaust system 1 (only a portion of which is shown here) of an internal combustion engine (not shown) comprises at least one component 2, which is tied into an exhaust line 3 of the exhaust system 1, for example. The exhaust system 1 serves to carry away the exhaust gases from the internal combustion engine, which may be installed in a motor vehicle, for example. Accordingly, the component 2 also serves to carry away the exhaust, i.e., the component 2 has exhaust gases flowing through it during operation of the internal combustion engine.

The component 2 has a pipe 4 and a housing 5. The pipe 4 has two longitudinal ends, namely a first longitudinal end 6 and a second longitudinal end 7. The longitudinal ends 6, 7 are each open in the longitudinal direction of the pipe 4. In the present case, the pipe 4 extends in a straight line, so that the longitudinal ends 6, 7 are open axially. In addition, the pipe 4 is designed to be cylindrical here, whereby it may have a circular or elliptical cross section. Essentially, an embodiment having a curved pipe 4 is also conceivable.

The exhaust gas can thus flow through the pipe 4 from one (the first) longitudinal end 6 to the other (the second) longitudinal end 7 during operation of the internal combustion engine. Between its longitudinal ends 6, 7, the pipe 4 has a longitudinal section 8 designated by the bracket. In this longitudinal section 8, the pipe 4 has a wall 9, which is provided with perforations 10. In contrast with that, end areas, namely a first end area 11 and a second end area 12 of the pipe are each provided with a wall 9' which does not have any perforations 10.

The pipe 4 is designed to be permeable radially for airborne sound through the perforations 10 in its longitudinal section 8.

The pipe 4 is fixedly connected to the housing 5 with the first end area 11, which has the first longitudinal end 6. Likewise, the pipe 4 is also fixedly connected to the housing 5 with its second end area 12 which has the second longitudinal end 7. The fixed connection between the housing 5 and the end areas 11, 12 of the pipe 4 may be implemented, for example, by soldered connections or by welded connections or by flange connections or in some other equally effective manner. This results in an intense reinforcing effect of the housing 5 in the longitudinal sections of the housing 5 assigned to the end areas 11, 12.

The perforations 10 of the longitudinal section 8 of the pipe 4 are designed specifically in such a way that the longitudinal section 8 can absorb thermally induced longitudinal expansion forces between the pipe 4 and the housing 5 by the fact that the longitudinal section 8 undergoes elastic deformation. For example, during operation of the exhaust system 1, the pipe 4, which is directly exposed to the exhaust gas, becomes much hotter than the housing 5, which can also emit heat into the environment. This results in a temperature difference between the pipe 4 and the housing 5 which leads to extremely different longitudinal expansion in the pipe 4 on the one hand and in the housing 5 on the other hand. Additionally or alternatively, the choice of materials for the pipe 4 and the housing 5 may also lead to differences in longitudinal expansion. For example, combinations of austenite and ferrite are typical. The pipe 4 has a tendency to expand much more in its longitudinal direction than does the housing 5. The pipe 4 is fixedly attached to the housing 5 in its end areas 11, 12 in the case of the component 2 shown here so the pipe 4 cannot expand to the required extent in comparison with the housing 5, so that corresponding longitudinal expansion forces occur between the pipe 4 and the housing 5. Due to the perforations 10, the pipe 4 is softer than the housing 5 so that the longitudinal section 8 can be compressed (an elastic pre-compression between fixation locations—end areas 11, 12 of the pipe 4). Because of the perforations 10 designed specifically in this way, this compression takes place largely in the elastic deformation range of the longitudinal section 8. The resulting longitudinal expansion forces may thus be absorbed by the longitudinal section 8 essentially with spring elasticity. Due to the spring elasticity of the longitudinal section 8 and/or the pipe 4 achieved with the help of the perforations 10, different longitudinal expansions can be absorbed without excessive forces acting on the pipe 4, the housing 5 and the connection points between the pipe 4 and the housing 5.

The design of the perforations 10 is preferably such that the longitudinal section 8 can still absorb the thermal longitudinal expansion forces between the pipe 4 and the housing 5 essentially through elastic deformation which can occur with the maximum temperature difference to be expected between the pipe 4 and the housing 5 during normal operation of the exhaust system 1 and/or the internal combustion engine equipped therewith.

The deformations that occur in the longitudinal section 8 are mainly elastic. It is clear that plastic deformation may also occur over the lifetime of the component 2. Due to the perforations 10, the deformations in the longitudinal section 8 thus occur in the elastic area, so that any plastic deformation of the pipe 4 that may also occur cannot cause any serious damage to the pipe 4 during the anticipated lifetime of the component 2.

Since the two end areas 11, 12 can be attached to the housing 5 in the same way, a symmetrical design for the pipe 4 and the housing 5 is possible. This makes it possible to simplify the assembly of the component 2. In addition, the production of the pipe 4 and the production of the housing 5 can be simplified. In particular, the housing 5 may be assembled from two identical half shells, for example.

With the preferred embodiment shown here, the perforations 10 are formed by a plurality of elongated holes 13. The individual elongated holes 13 are arranged in the wall 9 in such a way that they extend with their longitudinal direction aligned in the circumferential direction of the pipe 4. In addition, all elongated holes 13 are preferably designed to be of the same size. The elongated holes 3 are arranged here in hole rows 14. These rows of holes each contain several elongated holes 13 arranged a distance apart from one another in the circumferential direction of the pipe 4 and are adjacent to one another in the longitudinal direction of the pipe 4. Each row of holes 14 may have, for example, two to ten elongated holes 13 or four to eight elongated holes 13 or six elongated holes 13, for example.

To achieve the desired spring elastically of the pipe 4 in the longitudinal direction of the pipe, the elongated holes 13 of each row of holes 14 are arranged so they are offset in the circumferential direction of the pipe 4 with respect to the elongated holes 13 of a row of holes 14 adjacent in the longitudinal direction of the pipe 4. In the preferred embodiment shown here, the offset 15 between the elongated holes 13 of the one row of holes 14 with respect to the elongated holes 13 of the row of holes 14 adjacent thereto in the longitudinal direction of the pipe is exactly the same size as a half length 16 of an elongated hole 13, as measured in the circumferential direction of the pipe, plus a half distance 17, measured in the circumferential direction of the pipe, between two neighboring elongated holes 13 of the same row of holes 14. This yields a symmetrical overlap of the neighboring elongated holes 13 with respect to the distances 17 from one row of holes 14 to the next row of holes 14. Due to this offset 15, it is possible to avoid having a web pass continuously through the longitudinal section 8 in the longitudinal direction of the pipe.

The distance 17 between adjacent elongated holes 13 of the same row of holes 14 as measured in the circumferential direction of the pipe amounts to approximately one-third of the length 16 of one of the elongated holes 13, for example. In addition, a distance 18 between two neighboring rows of holes 14, measured in the longitudinal direction of the pipe, may be selected to be approximately the same as a width 19 of one of the elongated holes 13 measured in the longitudinal direction of the pipe. Due to the preferred dimensioning of the elongated holes 13, the desired spring elasticity of the pipe 4 in its longitudinal direction can be achieved in combination with the selected arrangement of the individual elongated holes 13.

In other embodiments, the perforations 10 may also be implemented with openings having a geometric shape differing from that of the elongated holes 13.

In order for the spring elasticity of the pipe 4 to be as soft as possible, the perforated longitudinal section 18 expediently extends directly from the first end area 11 to the second end area 12.

In the embodiment shown here, the component 2 is designed as a muffler, in particular as a front muffler. To do so, the housing 5 surrounds the pipe 4 at a distance radially between the end areas 11, 12, thus forming an annular space 20 radially between the pipe 4 and the housing 5. This annular space 20, also known as the absorption space, is preferably filled with a sound-absorbing material 21 or an absorption material. During operation of the internal combustion engine, airborne sound propagating in the exhaust gas may enter the annular space 20 through the perforations 10 across the direction of flow, then is dampened to varying extents by the sound-absorbing material. With such a muffler, the pipe 4 passes completely through the housing 5 so that the length of the housing 5 measured in the longitudinal direction of the pipe corresponds approximately to the length of the pipe 4.

In another embodiment, it is possible for the pipe 4 to extend only inside a partial area of the housing 5. For example a funnel-shaped design of the pipe 4 is conceivable. The pipe 4 may form, for example, an inner funnel which is situated in a housing section designed as an outer funnel to implement an air gap insulation. Whereas such inner funnels are arranged so they are cantilevered and/or freestanding traditionally at one axial end due to the expected thermal longitudinal changes, it is possible due to the perforated longitudinal section 8 to connect the pipe 4 which is designed as an inner funnel fixedly to the housing at its two end areas 11, 12.

While specific embodiments of the invention have been shown and described in detail to illustrate the application of the principles of the invention, it will be understood that the invention may be embodied otherwise without departing from such principles.

What is claimed is:

1. An exhaust-carrying component of an exhaust system for an internal combustion engine, the component comprising:

a pipe through which exhaust gas can flow from one longitudinal end with an end area to another longitudinal end with another end area, said pipe having a longitudinal section between said one longitudinal end and said another longitudinal end, said longitudinal section of said pipe having perforations;

a housing which surrounds said pipe in a circumferential direction thereof, said housing being fixedly connected to said pipe in said end area and in said another end area;

wherein said perforations are designed so that said longitudinal section absorbs thermal longitudinal expansion forces between said pipe and said housing essentially through elastic deformation, said perforations being formed via elongated holes, each elongated hole having an elongated hole longitudinal direction extending in the circumferential direction of said pipe, said perforations comprising a plurality of adjacent rows of said elongated holes with respect to a longitudinal direction of said pipe, each of said rows comprising a plurality of elongated holes spaced a distance apart with respect to the circumferential direction of said pipe, said elongated holes of one of said rows of holes being arranged offset in the circumferential direction of said pipe with respect to said elongated holes of an adjacent row of said rows of holes.

2. The component according to claim 1, wherein the perforations are designed so that the longitudinal section can absorb the thermal longitudinal expansion forces occurring between said pipe and said housing essentially through elastic deformation at the maximum expected temperature difference between said pipe and said housing during operation of the exhaust system.

3. The component according to claim 1, wherein each row of said holes has one of two to ten, four to eight or six elongated holes.

4. The component according to claim 1, wherein said elongated holes of one of said rows of holes is arranged offset in the circumferential direction of said pipe with respect to said elongated holes of an adjacent row of said rows of holes wherein said offset is equal to half a length of an elongated hole of said adjacent row or said offset provides a circumferential position of each hole of said one of said rows at a location half the distance

5. The component according to claim 1, wherein rows adjacent said rows of holes, in the longitudinal direction of said pipe, are spaced a distance apart from one another that is approximately equal to a width of an elongated hole measured in the longitudinal direction of said pipe.

6. The component according to claim 1, wherein each hole of one of said row of holes is located at a distance from an adjacent elongated hole in the circumferential direction of said pipe to define a circumferential spacing between each hole of said one of said row of holes, said circumferential spacing being equal to approximately one-third the length of one of the elongated holes, measured in the circumferential direction of said pipe.

7. The component according to claim 1, wherein the perforated longitudinal section extends from said one end area to said another end area.

8. The component according to claim 1, wherein said pipe is one of cylindrical-shaped and funnel-shaped.

9. The component according to claim 1, wherein said pipe has one of a circular and elliptical cross section.

10. The component according to claim 1, wherein said pipe completely passes through said housing.

11. The component according to claim 1, wherein said housing and said pipe form a front muffler.

12. The component according to claim 1, wherein one elongated hole has a shape substantially similar to another elongated hole.

13. The component according to claim 1, wherein said housing is spaced a radial distance away from said pipe between said end area and said another end area of said pipe to define an annular space having a radial extent between said pipe and the housing.

14. The component according to claim 13, further comprising sound-absorbing material, wherein said annular space is filled with said sound-absorbing material.

15. A motor vehicle exhaust system for an internal combustion engine, the system comprising:

an exhaust line;

an exhaust component comprising:

a pipe through which exhaust gas can flow from one longitudinal end with an end area to another longitudinal end with another end area, said pipe having a longitudinal section between said one longitudinal end and said another longitudinal end;

a housing which surrounds said pipe in a circumferential direction thereof, said housing being fixedly connected to said pipe in said end area and in said another end area;

an elastic deformation means defined at said longitudinal section for absorbing thermal longitudinal expansion forces between said pipe and said housing essentially through elastic deformation, said elastic deformation means comprising a perforation arrangement in said longitudinal section of said pipe providing an elastic deformation region, said perforation arrangement including a plurality of rows of elongated holes located along a longitudinal length of said longitudinal section, each elongated hole having an elongated hole longitudinal direction extending in said circumferential direction of said pipe, said elongated holes of one of said rows of holes being offset in the circumferential direction of said pipe from said elongated holes of an adjacent row of said rows of holes, said offset being equal to half a length of one of said elongated holes of said adjacent row, each hole of one of said rows of holes being located at a distance from an adjacent elongated hole in the circumferential direction of said pipe to define a circumferential spacing between each hole of said one of said row of holes, said circumferential spacing being equal to one-third the length of one of the elongated holes, measured in the circumferential direction of said pipe.

16. The system according to claim 15, wherein one elongated hole is of a size equal to another elongated hole.

17. An exhaust-carrying component of an exhaust system for an internal combustion engine, the component comprising:

a pipe through which exhaust gas can flow from one longitudinal end with an end area to another longitudinal end with another end area, said pipe having a longitudinal section between said one longitudinal end and said another longitudinal end, said longitudinal section having elastic deformation region with a perforation arrangement;

a housing which surrounds said pipe in a circumferential direction thereof, said housing being fixedly connected to said pipe in said end area and in said another end area, said elastic deformation region elastically absorbing a portion of thermal longitudinal expansion forces between said pipe and said housing, said perforation arrangement including perforations formed by elongated holes having an elongated hole longitudinal direction extending in the circumferential direction of said pipe, said perforations comprising multiple adjacent rows of holes with respect to the longitudinal direction of said pipe, each of said rows comprising a plurality of elongated holes spaced a distance apart with respect to the circumferential direction of said pipe, each elongated hole having a size equal to a size of another elongated hole.

18. The component according to claim 17, wherein said elongated holes of one of said rows of holes area is arranged offset in the circumferential direction of said pipe with respect to said elongated holes of an adjacent row of said rows of holes.

19. The component according to claim 18, wherein one elongated hole is of a size equal to another elongated hole, said offset being equal to half a length of one of said elongated holes of said adjacent row, each hole of one of said rows of holes being located at a distance from an adjacent elongated hole in the circumferential direction of said pipe to define a circumferential spacing between each hole of said one of said row of holes, said circumferential spacing being equal to one-third the length of one of the elongated holes, measured in the circumferential direction of said pipe.

* * * * *